US005649449A

United States Patent [19]

Algers

[11] Patent Number: 5,649,449

[45] Date of Patent: Jul. 22, 1997

[54] METHOD AND APPARATUS FOR DETERMINING THE INSTANTANEOUS OPERATION CONDITIONS OF A CENTRIFUGAL PUMP

[75] Inventor: Bengt Algers, Nol, Sweden

[73] Assignee: ABS Pump Production AB, Molndal, Sweden

[21] Appl. No.: 637,519

[22] Filed: Apr. 25, 1996

[30] Foreign Application Priority Data

Apr. 25, 1995 [SE] Sweden ..... 9501514

[51] Int. Cl.[6] ..... G01M 19/00

[52] U.S. Cl. ..... 73/168; 73/861.75

[58] Field of Search ..... 73/168, 861.75

[56] References Cited

U.S. PATENT DOCUMENTS

| | | | |
|---|---|---|---|
| 3,943,891 | 3/1976 | Kinugawa | 73/861.75 |
| 5,329,956 | 7/1994 | Marriott et al. | 73/168 |
| 5,383,351 | 1/1995 | Kotlyar | 73/168 |

*Primary Examiner*—John T. Kwon

*Attorney, Agent, or Firm*—Cohen, Pontani, Lieberman, Pavane

[57] ABSTRACT

In the disclosed method of determining the current or instantaneous operating conditions of a centrifugal pump, the radial forces impressed on the impeller shaft by the operatively rotating pump impeller are measured at a shaft-supporting bearing disposed proximate the pump housing and impeller. In a preliminary or test operation of the pump, this radial force measurement is taken at a plurality of volumetric liquid flow rates through the pump so as to develop a relationship between the radial force and liquid flow. Then, during normal operation of the pump, the current or instantaneous radial force is measured at the bearing and this measurement is compared to the previously-developed relationship to accurately determine the instantaneous operating conditions of the pump by identifying the point along the pump's characteristic curve—which defines for the pump a relationship between lifing height and volumetric liquid flow—at which the pump is currently operating.

13 Claims, 2 Drawing Sheets

FIG. 1
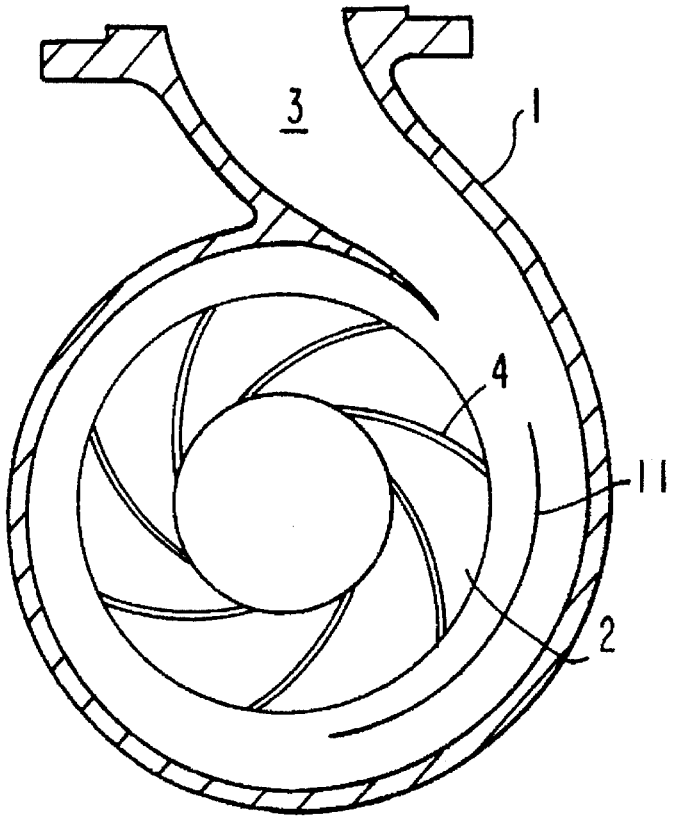
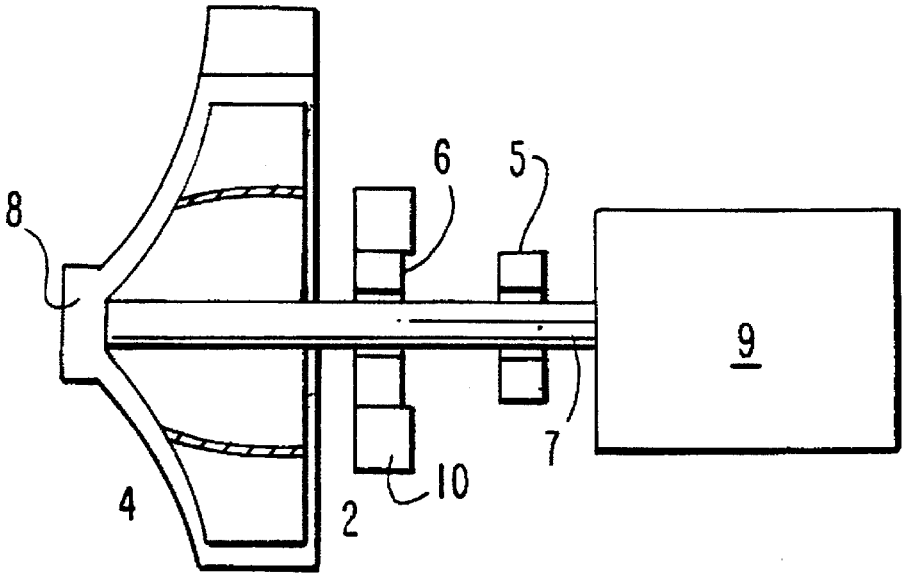
FIG. 2

METHOD AND APPARATUS FOR DETERMINING THE INSTANTANEOUS OPERATION CONDITIONS OF A CENTRIFUGAL PUMP

FIELD OF THE INVENTION

The present invention is directed to a method and apparatus for determining the current or instantaneous working or operating conditions of a centrifugal pump. More particularly, the inventive method identifies the actual point of operation along the pump's characteristic curve—which defines the relationship of lifting height to volumetric liquid flow through the pump at a given pump impeller rotation speed—to facilitate efficient operation of the pump.

BACKGROUND OF THE INVENTION

A centrifugal pump for the forced transfer of liquids generally includes a spiral-shaped housing within which an impeller having a plurality of blades operatively rotates. The impeller is mounted on a shaft that is supportedly carried on bearings disposed about the shaft. As a consequence of the spiral shape of the housing, the distance between the impeller shaft and the outer or peripheral wall of the housing varies continuously as the impeller operatively rotates, thus producing a radial force on the impeller. These radial forces are transferred to the pump shaft and carried by the bearings. Such pumps are designed to maximize their operating efficiency, and to minimize the radial forces on the impeller, at or under certain predefined working or operating conditions. A pump's characteristic curve defines the relationship between the pump's lifting height and the volumetric liquid flow through the pump at a given pump impeller rotation speed, and may be employed—if the then-current or instantaneous operating point along the curve is accurately determinable—to facilitate efficient operation of the pump.

The use of heretofore known devices for determining a pump's current operating conditions and identifying the point along the pump's characteristic curve at which it is operating requires that the pump incorporate two liquid outlets for measuring the pressure at or adjacent the pump. In addition to the practical and technical drawbacks and other implications of such a design, the resulting measurements are comparatively unreliable as an indicator of the pump's then-current operating condition. A precise determination of the actual current operating point of the pump along its characteristic curve is important where, for example, the pump forms a part of a processing stage or apparatus and is controllable, using or on the basis of reliably-measured values, to maximize its efficient operation in the process.

Using the method of the present invention the magnitude and direction of the radial forces imposed on the pump or impeller shaft are measured with great precision. These values are then compared with previously-measured or determined or otherwise known values to accurately identify the actual point along the pump characteristic curve at which the pump is operating.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views:

FIG. 1 is a diagrammatic cross sectional end view of a centrifugal pump housing;

FIG. 2 is a cross-sectional side view of the pump of FIG. 1 taken vertically through the impeller shaft and supporting bearings;

DETAILED DESCRIPTION OF THE PREFERRED EMBODIMENTS

Figure 3:
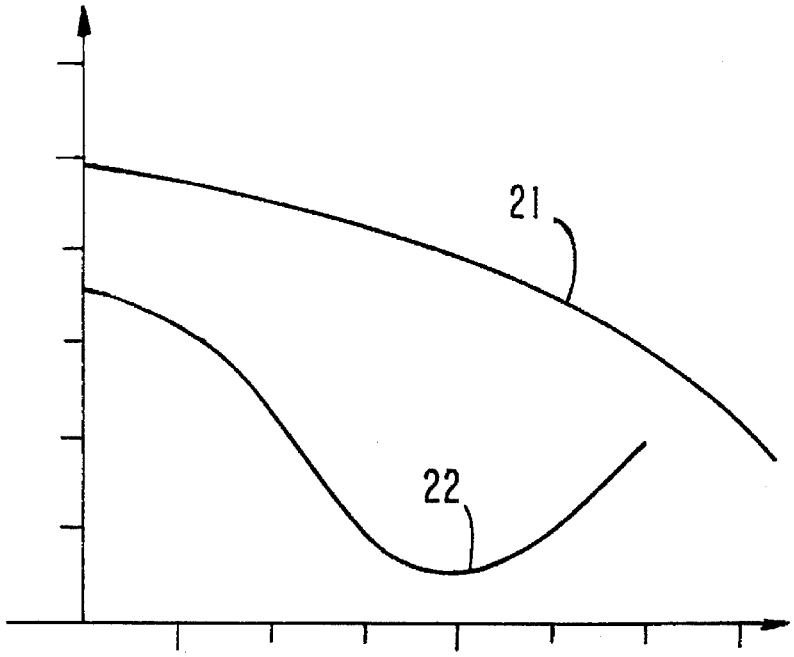
FIG. 3 graphically depicts the relationship between the pump characteristic curve and a second curve, generated in accordance with the present invention, representing the magnitude of the radial forces impressed on the rotating impeller shaft as a function of volumetric liquid flow through the operating pump.

The pump diagrammatically depicted in FIGS. 1 and 2 includes a generally spiral-shaped housing 1 within which an impeller 2 having a plurality of radially outwardly extending blades 4 is rotatably disposed. Housing 1 defines, in addition to its interior impeller chamber, an inlet 8 and an outlet 3 through which liquid is operatively driven or forced by the pump respectively into and out from the housing 1. The illustrated pump is also provided with an intermediate wall 11 within its interior chamber and inwardly spaced from the peripheral wall that bounds the chamber, an arrangement present in certain centrifugal pumps but which is not required by the present invention. The impeller is rotatably driven by a motor 9 through the pump or impeller shaft 7. As seen in FIG. 2, the shaft 7 is supported for rotation in two, by way of example, bearings 5, 6 spaced longitudinally along the shaft; the type and number of bearings is generally dependent on the size and other properties of the particular pump.

Associated with a centrifugal pump of the type to which the inventive method is directed is what is commonly referred to as the pump's characteristic curve. As previously pointed out, the characteristic curve 21, depicted by way of example in FIG. 3, defines the relationship between the pump's lifting height and the volumetric liquid flow through the pump at a given pump impeller rotation speed. Knowledge of the point along the characteristic curve 21 at which a pump is currently operating enables selective adjustment of the pump's operating parameters and conditions, as for example by varying the rotational speed of the impeller, to maximize efficient operation of the pump and of an apparatus of which the pump may form a part.

Figure 4:
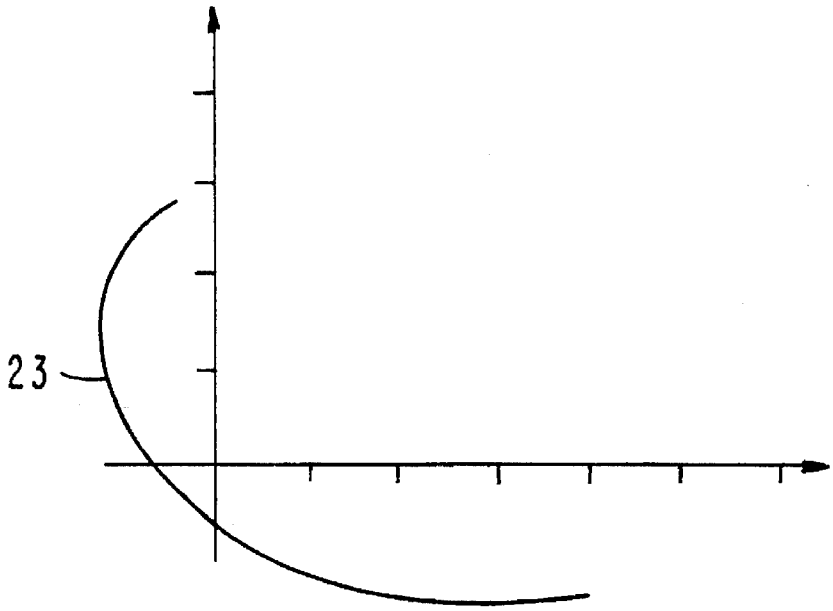
FIG. 4 graphically depicts the relationship between the direction of the radial forces impressed on the rotating impeller shaft as a function of volumetric liquid flow through the operating pump.

In accordance with the invention, the radial forces that are transferred to the shaft 7 from the operatively rotating impeller 2 are measured by a measuring device 10 that surrounds or is disposed immediately radially outwardly from or is otherwise associated with or disposed closely proximate one of the bearings 5, 6. In a most preferred form of the invention, these forces are measured at the first or front bearing 6—i.e. the bearing located closest to the housing 1 or impeller 2. The measuring device 10 may, by way of preferred example, comprise a so-called pressductor radial tensiometer, through which the magnitude and direction of the forces or load on the shaft 7 are measureable along four discrete orientations or directions defined at right angles to one another. By making a number of such measurements under controlled operating conditions and at known volumetric liquid flow rates in further accordance with the invention, the curves 22 and 23 of respective FIGS. 3 and 4 are developed or defined for the particular pump. Curve 22 defines the magnitude of the radial forces, as measured by the measuring device 10, impressed on the rotating impeller shaft as a function of volumetric liquid flow through the operating pump, and is shown plotted against the characteristic curve 21 of the pump. Curve 23 plots the relationship between the place or direction of the measured radial forces impressed on the rotating impeller shaft as a function of volumetric liquid flow through the operating pump, and may similarly be plotted against the pump's characteristic curve 21. It is anticipated, in accordance with the invention, that the curves 22, 23 will typically be experimentally determined and plotted by the manufacturer of the pump prior to its installation at its intended operating site—i.e. during testing operation of or a calibration procedure for the pump—although they may of course alternatively be prepared with the pump operating in a testing or calibration mode or the like in situ.

During or under normal working or operating conditions or use of the pump, and as a step of the inventive method, the then-current or instantaneous radial forces or load on the pump shaft 7 are measured by the measuring device 10. The location along the curve 22, and/or the curve 23, of the thus-measured value(s) is identified for the current liquid flow. The corresponding operating point along the pump's characteristic curve 21 is then identified, yielding this important current or instantaneous pump operating conditions information with a marginal error of no greater than a few percent. Continued or dynamic control over the operation of the pump to maintain maximum operating efficiency, and to minimize the radial forces on the pump shaft, is thus readily attainable with a degree of precision not heretofore attainable.

Those skilled in the art and now familiar with the present invention will recognize that the load on the pump shaft may also or alternatively be determined by measuring the shaft deflection that is caused by the radial forces working on the rotating impeller. For this purpose such devices as strain gauges and the like, mounted by way of example onto a bushing which surounds the shaft between the housing and the first or closest or front bearing, may be utilized. However, significant disadvantages may be presented with such devices because the bearing is displaced in a direction away from the impeller. Other methods for measuring the bending of the shaft are described, for example, in Great Britain Patents Nos. 1,303,993 and 1,303,904, although the methods therein described are more technically complex and have additional space requirements. They therefore exhibit disadvantages akin to those associated with strain gauges and may also result in increased uncertainty or inaccuracy of the measured values. In this regard, it will be appreciated that the bending of the shaft being measured may be no more than about 0.05 mm, as a consequence of which the preferred measurement of the deflecting or loading forces impressed on the pump shaft provides considerably more reliable values than measurement of the bending of the shaft caused by such loading forces.

Thus, while there have shown and described and pointed out fundamental novel features of the invention as applied to a preferred embodiment thereof, it will be understood that various omissions and substitutions and changes in the form and details of the devices illustrated, and in their operation, and in the method steps described, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for determining a current operating condition of an operating centrifugal pump having a rotatable impeller, an impeller shaft carrying the impeller, a bearing supporting the shaft, and a characteristic curve defining a first relationship between lifting height of the pump and volumetric liquid flow through the pump, comprising the steps of:

(a) measuring radial forces impressed on the impeller shaft by the rotating impeller at a plurality of volumetric liquid flow rates during a testing operation of the pump to define a second relationship for the pump between the impressed radial forces and the volumetric flow rate;

(b) measuring the radial forces impressed on the impeller shaft by the rotating impeller at a particular current instant during normal operation of the pump; and (c) comparing the measured radial forces measured at the particular instant to the second relationship measurements to determine the instantaneous operating conditions of the pump.

2. A method in accordance with claim 1, wherein said comparing step comprises comparing the measured radial forces measured at the particular instant to the second relationship measurement to identify the corresponding volumetric flow rate, and using the identified volumetric flow rate to identify a point along the characteristic curve of the pump at which the pump is currently operating.

3. A method in accordance with claim 1, further comprising the step of deriving a third relationship between the characteristic curve of the pump and the second relationship, and wherein said comparing step further comprises using the third relationship in said comparison to determine the instantaneous operating conditions of the pump.

4. A method in accordance with claim 1, further comprising the step of deriving a third relationship between the characteristic curve of the pump and the second relationship, and wherein said comparing step further comprises using the third relationship in said comparison to identify a point along the characteristic curve of the pump at which the pump is currently operating.

5. A method in accordance with claim 1, wherein each of said steps (a) and (b) further comprises measuring a magnitude and a direction of the radial forces impressed on the impeller shaft by the rotating impeller.

6. A method in accordance with claim 1, wherein each of said steps (a) and (b) further comprises measuring the radial forces at the bearing that carries the shaft.

7. A method in accordance with claim 1, wherein each of said steps (a) and (b) further comprises measuring the radial forces at the bearing that carries the shaft using a pressductor radial tensiometer disposed about the bearing.

8. A method in accordance with claim 7, wherein each of said steps (a) and (b) further comprises measuring, using the pressductor radial tensiometer, a magnitude and a direction of the radial forces impressed on the impeller shaft by the rotating impeller.

9. A method in accordance with claim 1 wherein the pump bearing comprises a first bearing and the pump further includes a second bearing supporting the shaft and spaced from the first bearing along the shaft so that the first bearing is disposed more closely proximate the impeller than the second bearing, each of said steps (a) and (b) further comprising measuring the radial forces at the said first bearing.

10. In a centrifugal pump operable for pumping a liquid through a pump housing having an inlet and an outlet, an elongated shaft;

means for operatively rotating the shaft;

an impeller mounted on the shaft in the pump housing for rotation with the shaft to operatively pump liquid through the housing between the inlet and the outlet;

a bearing supporting the shaft for operative rotation; and means for measuring at the bearing a radial force imparted to the shaft by the rotating impeller.

11. In a centrifugal pump in accordance with claim 10, said measuring means comprising means for measuring a magnitude and a direction of the radial force imparted to the shaft by the rotating impeller.

12. In a centrifugal pump in accordance with claim 10, said measuring means comprising a pressductor radial tensiometer surrounding said bearing.

13. In a centrifugal pump in accordance with claim 10 wherein said bearing comprises a first bearing and said pump further comprises a second bearing spaced from said first bearing along said shaft so that said first bearing is disposed more closely proximate the impeller than said first bearing, said measuring means comprising means for measuring the radial force imparted to the shaft by the rotating impeller at said first bearing.

* * * * *